US005749019A

United States Patent [19]

Mestha

[11] Patent Number: 5,749,019

[45] Date of Patent: May 5, 1998

[54] LOOK UP TABLE TO CONTROL NON-LINEAR XEROGRAPHIC PROCESS

[75] Inventor: Lingappa K. Mestha, Fairport, N.Y.

[73] Assignee: Xerox Corporation, Stamford, Conn.

[21] Appl. No.: 709,699

[22] Filed: Sep. 9, 1996

[51] Int. Cl.[6] ..... G03G 15/06; G03G 13/06; G03G 15/02; G03G 13/02

[52] U.S. Cl. ..... 399/46; 399/48; 399/49; 399/50; 399/53

[58] Field of Search ..... 399/46, 48, 50, 399/168, 53, 49

[56] References Cited

U.S. PATENT DOCUMENTS 5,162,850 11/1992 Nakashima .
5,164,776 11/1992 Oresick et al. .
5,243,383 9/1993 Parisi ..... 355/208
5,315,352 5/1994 Nakane et al. .
5,499,079 3/1996 Kinoshita et al. .
5,523,831 6/1996 Rushing .
5,581,221 12/1996 Kawai et al. .
5,619,308 4/1997 Kinoshita et al. ..... 399/48

*Primary Examiner*—R. L. Moses
*Attorney, Agent, or Firm*—Ronald F. Chapuran

[57] ABSTRACT

An electrostatographic printing machine having an imaging member, operating components, and a control system including a sensor, compensator, and look up table for adjusting the operating components. The sensor signal provides a suitable indication of an operating component condition such as a developer unit or a photoreceptor charging device. A compensator responds to the sensor signal to provide a non-linear adjustment signal and the look up table converts the non-linear adjustment signal to a linear adjustment signal. A device such as a charging corotron or developer power supply responds to the linear adjustment signal to appropriately adjust the operating component.

25 Claims, 4 Drawing Sheets

LOOK UP TABLE TO CONTROL NON-LINEAR XEROGRAPHIC PROCESS

This invention relates generally to an electrostatographic printing machine and, more particularly, concerns a process to adjust a xerographic control, in particular, to linearize the control for changing set points.

The basic reprographic process used in an electrostatographic printing machine generally involves an initial step of charging a photoconductive member to a substantially uniform potential. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the original document being reproduced. The latent image is then developed by bringing a developer material including toner particles adhering triboelectrically to carrier granules into contact with the latent image. The toner particles are attracted away from the carrier granules to the latent image, forming a toner image on the photoconductive member which is subsequently transferred to a copy sheet. The copy sheet having the toner image thereon is then advanced to a fusing station for permanently affixing the toner image to the copy sheet in image configuration.

In electrostatographic machines using a drum-type or an endless belt-type photoconductive member, the photosensitive surface thereof can contain more than one image at one time as it moves through various processing stations. The portions of the photosensitive surface containing the projected images, so-called "image areas", are usually separated by a segment of the photosensitive surface called the inter-document space. After charging the photosensitive surface to a suitable charge level, the inter-document space segment of the photosensitive surface is generally discharged by a suitable lamp to avoid attracting toner particles at the development stations. Various areas on the photosensitive surface, therefore, will be charged to different voltage levels. For example, there will be the high voltage level of the initial charge on the photosensitive surface, a selectively discharged image area of the photosensitive surface, and a fully discharged portion of the photosensitive surface between the image areas.

The approach utilized for multicolor electrostatographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color complimentary thereto and the process is repeated for differently colored images with the respective toner of complimentary color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished color copy.

As described, the surface of the photoconductive member must be charged by a suitable device prior to exposing the photoconductive member to a light image. This operation is typically performed by a corona charging device. One type of corona charging device comprises a current carrying electrode enclosed by a shield on three sides and a wire grid or control screen positioned thereover, and spaced apart from the open side of the shield. Biasing potentials are applied to both the electrode and the wire grid to create electrostatic fields between the charged electrode and the shield, between the charged electrode and the wire grid, and between the charged electrode and the (grounded) photoconductive member. These fields repel electrons from the electrode and the shield resulting in an electrical charge at the surface of the photoconductive member roughly equivalent to the grid voltage. The wire grid is located between the electrode and the photoconductive member for controlling the charge strength and charge uniformity on the photoconductive member as caused by the aforementioned fields.

Control of the field strength and the uniformity of the charge on the photoconductive member is very important because consistently high quality reproductions are best produced when a uniform charge having a predetermined magnitude is obtained on the photoconductive member. If the photoconductive member is not charged to a sufficient level, the electrostatic latent image obtained upon exposure will be relatively weak and the resulting deposition of development material will be correspondingly decreased. As a result, the copy produced by an undercharged photoconductor will be faded. If, however, the photoconductive member is overcharged, too much developer material will be deposited on the photoconductive member. The copy produced by an overcharged photoconductor will have a gray or dark background instead of the white background of the copy paper. In addition, areas intended to be gray will be black and tone reproduction will be poor. Moreover, if the photoconductive member is excessively overcharged, the photoconductive member can become permanently damaged.

A useful tool for measuring voltage levels on the photosensitive surface is an electrostatic voltmeter (ESV) or electrometer. The electrometer is generally rigidly secured to the reproduction machine adjacent the moving photosensitive surface and measures the voltage level of the photosensitive surface as it traverses an ESV probe. The surface voltage is a measure of the density of the charge on the photoreceptor, which is related to the quality of the print output. In order to achieve high quality printing, the surface potential on the photoreceptor at the developing zone should be within a precise range.

In a typical xerographic charging system, the amount of voltage obtained at the point of electrostatic voltage measurement of the photoconductive member, namely at the ESV, is less than the amount of voltage applied at the wire grid of the point of charge application. In addition, the amount of voltage applied to the wire grid of the corona generator required to obtain a desired constant voltage on the photoconductive member must be increased or decreased according to various factors which affect the photoconductive member. Such factors include the rest time of the photoconductive member between printing, the voltage applied to the corona generator for the previous printing job, the copy length of the previous printing job, machine to machine variance, the age of the photoconductive member and changes in the environment.

One way of monitoring and controlling the surface potential in the development zone is to locate a voltmeter directly in the developing zone and then to alter the charging conditions until the desired surface potential is achieved in the development zone. However, the accuracy of voltmeter measurements can be affected by the developing materials (such as toner particles) such that the accuracy of the measurement of the surface potential is decreased. In addition, in color printing there can be a plurality of developing areas within the developing zone corresponding to each color to be applied to a corresponding latent image. Because it is desirable to know the surface potential on the photoreceptor at each of the color developing areas in the developing zone, it would be necessary to locate a voltmeter at each color area within the developing zone. Cost and space limitations make such an arrangement undesirable.

In a typical charge control system, the point of charge application and the point of charge measurement is different. The zone between these two devices loses the immediate benefit of charge control decisions based on measured voltage error since this zone is downstream from the charging device. This zone may be as great as a belt revolution or more due to charge averaging schemes. This problem is especially evident in aged photoreceptors because their cycle-to-cycle charging characteristics are more difficult to predict. Charge control delays can result in improper charging, poor copy quality and often leads to early photoreceptor replacement. Thus, there is a need to anticipate the behavior of a subsequent copy cycle and to compensate for predicted behavior beforehand.

Various systems have been designed and implemented for controlling processes within a printing machine. For example, U.S. Pat. No. 5,243,383 discloses a charge control system that measures first and second surface voltage potentials to determine a dark decay rate model representative of voltage decay with respect to time. The dark decay rate model is used to determine the voltage at any point on the imaging surface corresponding to a given charge voltage. This information provides a predictive model to determine the charge voltage required to produce a target surface voltage potential at a selected point on the imaging surface.

U.S. Pat. No. 5,243,383 discloses a charge control system that uses three parameters to determine a substrate charging voltage, a development station bias voltage, and a laser power for discharging the substrate. The parameters are various difference and ratio voltages.

Process loops are designed to keep control of the electrostatics and the development system. They track setpoints for developed mass per unit area on the paper. To achieve the tracking of setpoints actuator parameters, grid voltage, laser power and donor voltages are varied in a controlled way with the help of compensator algorithms. These algorithms use the measured voltages on the photoreceptor and the toner mass. The process in the prior art, generally, is non-linear for the complete range over which the printer is expected to operate.

The paradigm of the printing process, in fact, is nonlinear, time varying, noisy and unfortunately, multivariable. Such systems are generally hard to control. On the other hand, using the assumption of linearity, process loops can be designed using modern multivariable linear control techniques. The linearized version of the nonlinear system gives good results at one operating point about which the system is approximately linear. Outside of that point, however, the control system performance will be different, which results in loss print quality. For designing control algorithms, it would be useful if the nonlinear process would be converted to a linear process at different operating points. This can be done in accordance with the present invention by artificially generating inverse system functions.

It would be desirable, therefore, to provide a linear approach to control, in particular, in which the linearization is done by using estimated lookup tables. The lookup tables would be obtained from experimental data once during a setup process. The look up table would act like an additional gain table in a multivariable control system. New values would be accessed from the table each time the operating point moves, thus preserving the linearity.

It is an object of the present invention, therefore, to be able to linearly adjust a xerographic system requiring multiple changes in various system integrators and compensators. It is another object of the present invention to be able to convert a non-linear response system to a linear response system over a wide range of operating variables. It is another object of the present invention to provide a look up table that linearizes control responses to changing parameters.

SUMMARY OF THE INVENTION

The present invention relates to an electrostatographic printing machine having an imaging member operating components, and a control system including a sensor, compensator, and look up table for adjusting the operating components. The sensor signal provides a suitable indication of an operating component condition such as a developer unit or a photoreceptor charging device. A compensator responds to the sensor signal to provide a non-linear adjustment signal and the look up table converts the non-linear adjustment signal to a linear adjustment signal. A device such as a charging corotron or developer power supply responds to the linear adjustment signal to appropriately adjust the charging device or developer unit.

Other features of the present invention will become apparent as the following description proceeds and upon reference to the drawings, in which.

Figure 1:
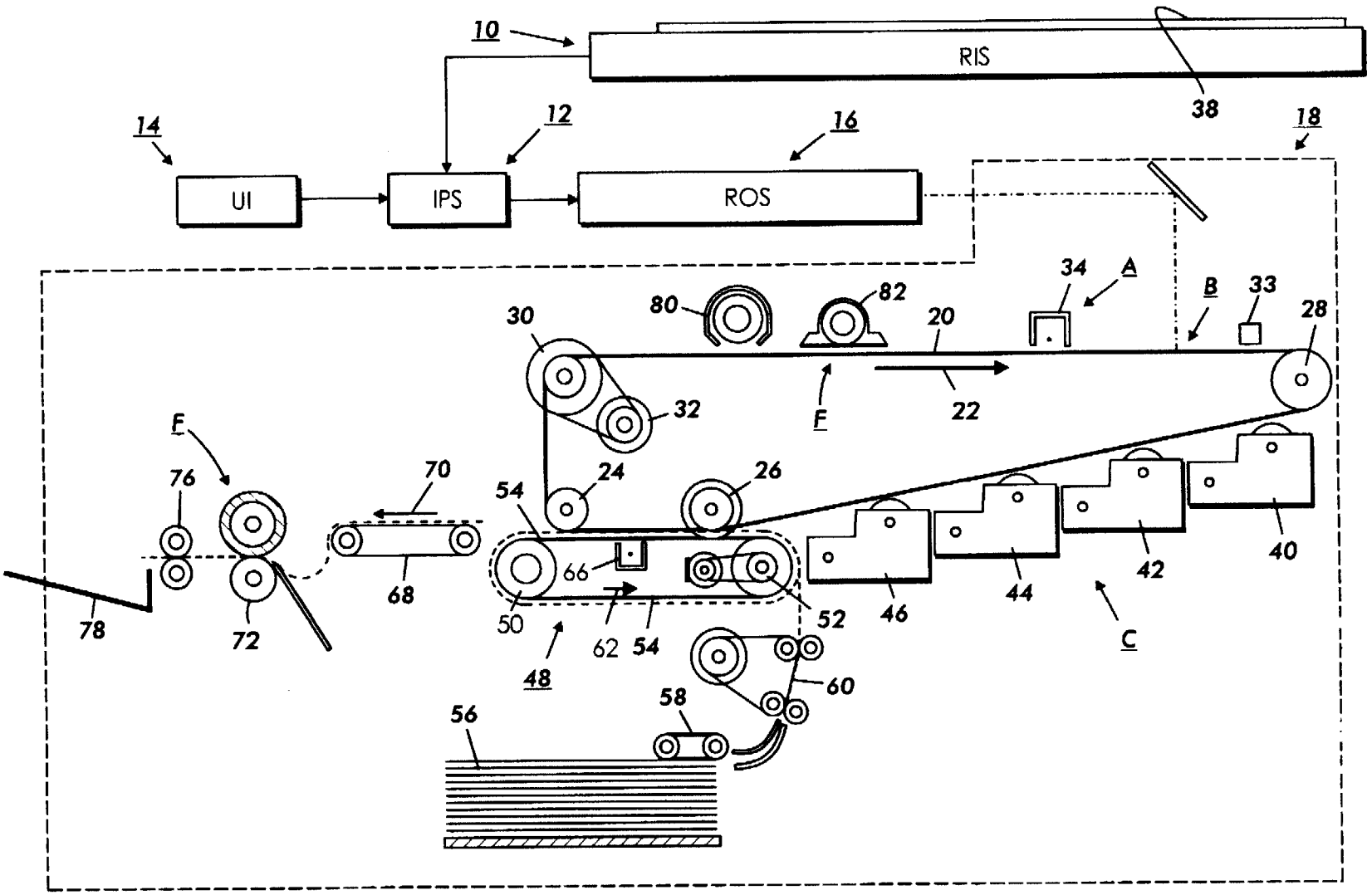
FIG. 1 is a schematic elevational view of an exemplary multi-color electrophotographic printing machine which can be utilized in the practice of the present invention.

For a general understanding of the features of the present invention, reference is made to the drawings wherein like references have been used throughout to designate identical elements. A schematic elevational view showing an exemplary electrophotographic printing machine incorporating the features of the present invention therein is shown in FIG. 1. It will become evident from the following discussion that the present invention is equally well-suited for use in a wide variety of printing systems including ionographic printing machines and discharge area development systems, as well as other more general non-printing systems providing multiple or variable outputs such that the invention is not necessarily limited in its application to the particular system shown herein.

Turning initially to FIG. 1, before describing the particular features of the present invention in detail, an exemplary electrophotographic copying apparatus will be described. The exemplary electrophotographic system may be a multicolor copier, as for example, the recently introduced Xerox Corporation "5775" copier. To initiate the copying process, a multicolor original document 38 is positioned on a raster input scanner (RIS), indicated generally by the reference numeral 10. The RIS 10 contains document: illumination lamps, optics, a mechanical scanning drive, and a charge coupled device (CCD array) for capturing the entire image from original document 38. The RIS 10 converts the image to a series of raster scan lines and measures a set of primary color densities, i.e. red, green and blue densities, at each point of the original document. This information is transmitted as an electrical signal to an image processing system (IPS), indicated generally by the reference numeral 12, which converts the set of red, green and blue density signals to a set of colorimetric coordinates. The IPS contains control electronics for preparing and managing the image data flow to a raster output scanner (ROS), indicated generally by the reference numeral 16.

A user interface (UI), indicated generally by the reference numeral 14, is provided for communicating with IPS 12. UI 14 enables an operator to control the various operator adjustable functions whereby the operator actuates the appropriate input keys of UI 14 to adjust the parameters of the copy. UI 14 may be a touch screen, or any other suitable device for providing an operator interface with the system. The output signal from UI 14 is transmitted to IPS 12 which then transmits signals corresponding to the desired image to ROS 16.

ROS 16 includes a laser with rotating polygon mirror blocks. The ROS 16 illuminates, via mirror 37, a charged portion of a photoconductive belt 20 of a printer or marking engine, indicated generally by the reference numeral 18 Preferably, a multi-facet polygon mirror is used to illuminate the photoreceptor belt 20 at a rate of about 400 pixels per inch. The ROS 16 exposes the photoconductive belt 20 to record a set of three subtractive primary latent images thereon corresponding to the signals transmitted from IPS 12. One latent image is to be developed with cyan developer material, another latent image is to be developed with magenta developer material, and the third latent image is to be developed with yellow developer material. These developed images are subsequently transferred to a copy sheet in superimposed registration with one another to form a multicolored image on the copy sheet which is then fused thereto to form a color copy. This process will be discussed in greater detail hereinbelow.

With continued reference to FIG. 1, marking engine 18 is an electrophotographic printing machine comprising photoconductive belt 20 which is entrained about transfer rollers 24 and 26, tensioning roller 28, and drive roller 30. Drive roller 30 is rotated by a motor or other suitable mechanism coupled to the drive roller 30 by suitable means such as a belt drive 32. As roller 30 rotates, it advances photoconductive belt 20 in the direction of arrow 22 to sequentially advance successive portions of the photoconductive belt 20 through the various processing stations disposed about the path of movement thereof.

Photoconductive belt 20 is preferably made from a polychromatic photoconductive material comprising an anti-curl layer, a supporting substrate layer and an electrophotographic imaging single layer or multi-layers. The imaging layer may contain homogeneous, heterogeneous, inorganic or organic compositions. Preferably, finely divided particles of a photoconductive inorganic compound are dispersed in an electrically insulating organic resin binder. Typical photoconductive particles include metal free phthalocyanine, such as copper phthalocyanine, quinacridones, 2,4-diaminotriazines and polynuclear aromatic quinines. Typical organic resinous binders include polycarbonates, acrylate polymers vinyl polymers, cellulose polymers, polyesters, polysiloxanes, polyamides, polyurethanes, epoxies, and the like.

Initially, a portion of photoconductive belt 20 passes through a charging station, indicated generally by the reference letter A. At charging station A, a corona generating device 34 or other charging device generates a charge voltage to charge photoconductive belt 20 to a relatively high, substantially uniform voltage potential. The corona generator 34 comprises a corona generating electrode, a shield partially enclosing the electrode, and a grid disposed between the belt 20 and the unenclosed portion of the electrode. The electrode charges the photoconductive surface of the belt 20 via corona discharge. The voltage potential applied to the photoconductive surface of the belt 20 is varied by controlling the voltage potential of the wire grid.

Next, the charged photoconductive surface is rotated to an exposure station, indicated generally by the reference letter B. Exposure station B receives a modulated light beam corresponding to information derived by RIS 10 having a multicolored original document 38 positioned thereat. The modulated light beam impinges on the surface of photoconductive belt 20, selectively illuminating the charged surface of photoconductive belt 20 to form an electrostatic latent image thereon. The photoconductive belt 20 is exposed three times to record three latent images representing each color.

After the electrostatic latent images have been recorded on photoconductive belt 20, the belt is advanced toward a development station, indicated generally by the reference letter C. However, before reaching the development station C, the photoconductive belt 20 passes subjacent to a voltage monitor, preferably an electrostatic voltmeter 33, for measurement of the voltage potential at the surface of the photoconductive belt 20. The electrostatic voltmeter 33 can be any suitable type known in the art wherein the charge on the photoconductive surface of the belt 20 is sensed, such as disclosed in U.S. Pat. Nos. 3,870,968; 4,205,257; or 4,853,639, the contents of which are incorporated by reference herein.

A typical electrostatic voltmeter is controlled by a switching arrangement which provides the measuring condition in which charge is induced on a probe electrode corresponding to the sensed voltage level of the belt 20. The induced charge is proportional to the sum of the internal capacitance of the probe and its associated circuitry, relative to the probe-to-measured surface capacitance. A DC measurement circuit is combined with the electrostatic voltmeter circuit for providing an output which can be read by a conventional test meter or input to a control circuit, as for example, the control circuit of the present invention. The voltage potential measurement of the photoconductive belt 20 is utilized to determine specific parameters for maintaining a predetermined potential on the photoreceptor surface, as will be understood with reference to the specific subject matter of the present invention, explained in detail hereinbelow.

The development station C includes four individual developer units indicated by reference numerals 40, 42, 44 and 46. The developer units are of a type generally referred to in the art as "magnetic brush development units". Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42, and 44, respectively, apply toner particles of a specific color corresponding to the compliment of the specific color separated electrostatic latent image recorded on the photoconductive surface. Each of the toner particle colors is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

In FIG. 1, developer unit 40 is shown in the operative position with developer units 42, 44 and 46 being in the non-operative position. During development of each electrostatic latent image, only one developer unit is in the operative position, while the remaining developer units are in the non-operative position. Each of the developer units is moved into and out of an operative position. In the operative position, the magnetic brush is positioned substantially adjacent the photoconductive belt, while in the non-operative position, the magnetic brush is spaced therefrom. Thus, each electrostatic latent image or panel is developed with toner particles of the appropriate color without commingling.

After development, the toner image is moved to a transfer station, indicated generally by the reference letter D. Transfer station D includes a transfer zone, generally indicated by reference numeral 64, defining the position at which the toner image is transferred to a sheet of support material, which may be a sheet of plain paper or any other suitable support substrate. A sheet transport apparatus, indicated generally by the reference numeral 48, moves the sheet into contact with photoconductive belt 20. Sheet transport 48 has a belt 54 entrained about a pair of substantially cylindrical rollers 50 and 52. A friction retard feeder 58 advances the uppermost sheet from stack 56 onto a pre-transfer transport 60 for advancing a sheet to sheet transport 48 in synchronism with the movement thereof so that the leading edge of the sheet arrives at a preselected position, i.e. a loading zone. The sheet is received by the sheet transport 48 for movement therewith in a recirculating path. As belt 54 of transport 48 moves in the direction of arrow 62, the sheet is moved into contact with the photoconductive belt 20, in synchronism with the toner image developed thereon.

In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this manner, three different color toner images are transferred to the sheet in superimposed registration with one another. Each of the electrostatic latent images recorded on the photoconductive surface is developed with the appropriately colored toner and transferred, in superimposed registration with one another, to the sheet for forming the multi-color copy of the colored original document. One skilled in the art will appreciate that the sheet may move in a recirculating path for four cycles when undercolor black removal is used.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference letter E, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference letter F. A lamp 80 illuminates the surface of photoconductive belt 20 to remove any residual charge remaining thereon. Thereafter, a rotatably mounted fibrous brush 82 is positioned in the cleaning station and maintained in contact with photoconductive belt 20 to remove residual toner particles remaining from the transfer operation prior to the start of the next successive imaging cycle.

Figure 2:
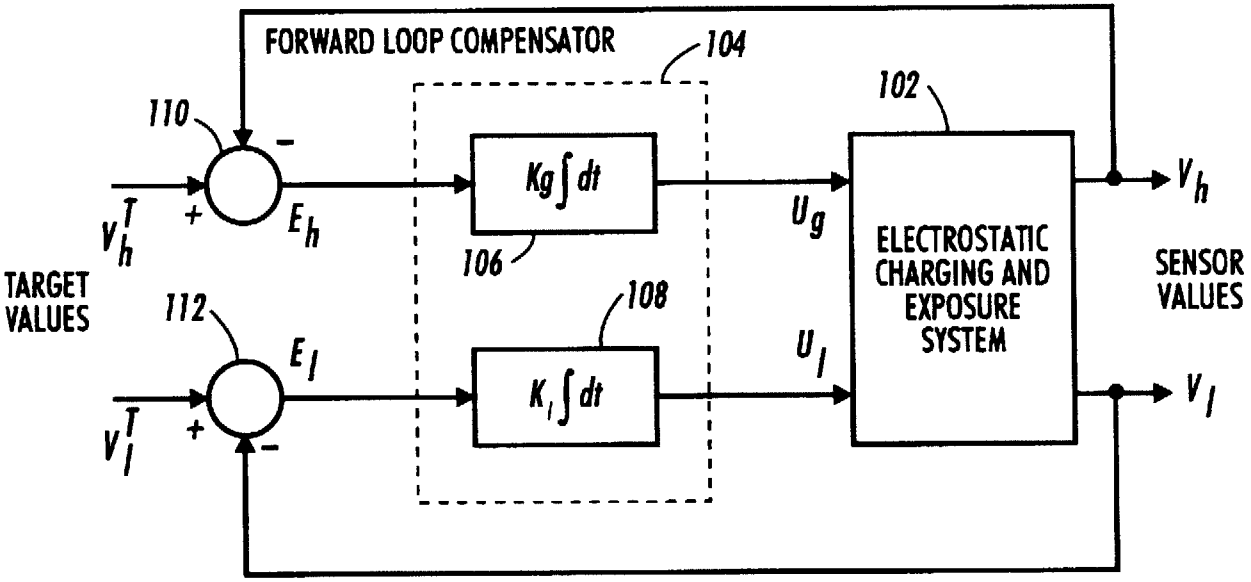
FIG. 2 is a diagram of a typical prior art electrostatic feedback control system.

A prior art diagrammatic representation of the system currently under practice for most xerographic print engines is shown in FIG. 2. Block 102 represents the charging and exposure systems. The block 104 representing compensators usually contains suitable integrators such as 106, 108 with some weighting. Here $V_h$ represents the voltage on the unexposed photoreceptor and $V_1$, represents the voltage after the exposure. $V^t_h$ and $V^t_l$ are the desired states for the voltages $V_h$ and $V_l$ and $E_h$ is the error generated by subtracting the $V^t_h$ values with those measured by the ESV. Similarly, $E_l$ is the error generated by subtracting the $V^t_l$ values with those measured by the ESV. $U_g$ and $U_l$ are the control signals to vary the grid voltage and laser power respectively.

When the setpoint changes, there is a large error created by the system. Within a few prints $V_h$ and $V_l$ settle to new target values depending on the integrator weights. The difficult problem is in tuning the controller weights to trace the $V_h$ and $V_l$ target values so that the best print quality is preserved even if the electrostatic system drifts with time. The problem becomes even more difficult when there are many gains involved in the controller.

In accordance with the present invention, linearization techniques are first discussed for electrostatic control. After that similar techniques are extended for implementing control for tracking Area Coverage or DMA setpoints.

Linearization lookup tables are obtained from a small signal model disclosed in pending D/95541 Serial No. (not yet assigned) incorporated herein. If $B_{11}$, $B_{12}$ and $B_{22}$ are the slopes of the curves of photoreceptor voltage versus grid voltage and laser power at given operating points on the curves, then the small signal model is written as:

$$\Delta V_h = B_{11}\Delta U_g + B_{12}\Delta U_l$$

$$\Delta V_l = B_{21}\Delta U_g + B_{22}\Delta U_l$$

$$\text{i.e.,} \begin{bmatrix} \Delta Vh \\ \Delta Vl \end{bmatrix} = \begin{bmatrix} B_{11} & B_{12} \\ B_{21} & B_{22} \end{bmatrix} \begin{bmatrix} \Delta Ug \\ \Delta Ul \end{bmatrix} \quad (1)$$

In the small signal model shown in Equation 1.

$V_h$=voltage on unexposed photoreceptor $V_l$=voltage on photoreceptor after exposure, $U_g$=control signal to vary grid voltage, and, $U_l$=control signal to vary laser power Equation 1 also contains the input matrix $\underline{B}$ to describe the model of the electrostatic system. To have the model valid for the full operating region, feedforward lookup tables are implemented as shown in pending D/95541. With this scenario the linearization of the system involves merely finding the inverse of the $\underline{B}$ matrix. This can be written in terms of the constituent elements as follows:

$$\underline{B}^{-1} = \begin{bmatrix} B_{11} & B_{12} \\ B_{21} & B_{22} \end{bmatrix}^{-1} \tag{2}$$

From suitable curves, the parameters of the $\underline{B}$ matrix can be extracted at one operating point. They are shown below:

$$B_{11} = 1.0039 \; B_{21} = 0.86641 \; B_{12} = 0 \; B_{21} = -662.5$$

The elements $B_{11i}$, $B_{12i}$, $B_{21i}$, $B_{22i}$ form an estimated lookup table for linearizing the non-linear system around one operating point. Similarly, when we move to another operating point over the curve, new elements of the $\underline{B}^{-1}$ matrix are obtained. The change in operating points are initiated when a change takes place in the target value. Likewise, satisfactory numbers of data points are initiated when a change takes place in the target value. Likewise, satisfactory numbers of data points are selected to describe the complete operating region. Having all the elements of the $\underline{B}^{-1}$ matrix the overall system used for controller design is transformed algebraically into a linear design, fully or partially. This will enable the application of linear control techniques.

After implementing the linearization look up table, the overall system for designing controllers becomes linear.

Before implementing the linear look up table, the state-space model of the system is set forth to:

$$\begin{bmatrix} x_{1k+1} \\ x_{2k+1} \end{bmatrix} = \begin{bmatrix} 1 & 0 \\ 0 & 0 \end{bmatrix} \begin{bmatrix} x_{1k} \\ x_{2k} \end{bmatrix} + \begin{bmatrix} B_{11} & B_{12} \\ B_{21} & B_{22} \end{bmatrix} \begin{bmatrix} \cup_{1k} \\ \cup_{2k} \end{bmatrix} \tag{4}$$

$$x_{1k+1} = A_{xk} + B\cup_k \tag{5}$$

After implementing the inverse $\underline{B}$ matrix table the new state space model of the system cancels the $\underline{B}$ matrix. Due to numerical approximation in the lookup table, one would not get an exact cancellation. Those small effects can be cured by robust controllers. The new state space model of the system becomes equal to:

$$\begin{bmatrix} x_{1k+1} \\ x_{2k+1} \end{bmatrix} = \begin{bmatrix} 1 & 0 \\ 0 & 0 \end{bmatrix} \begin{bmatrix} x_{1k} \\ x_{2k} \end{bmatrix} + \begin{bmatrix} 1 & 0 \\ 0 & 0 \end{bmatrix} \begin{bmatrix} \cup_{1k} \\ \cup_{2k} \end{bmatrix} \tag{6}$$

$$x_{1k+1} = A_{xk} + I\cup_k \tag{7}$$

In equation 7, matrices $\underline{A}$ and $\underline{I}$ are identity matrices. The $\underline{B}$ matrix is now mathematically converted to become the identity matrix, $\underline{I}$. As can be seen, this type of approach holds good only when the B matrix is invertible. In our xerographic printing system, models for electrostatics contained invertible $\underline{B}$ matrices for the full operating range.

Figure 3:
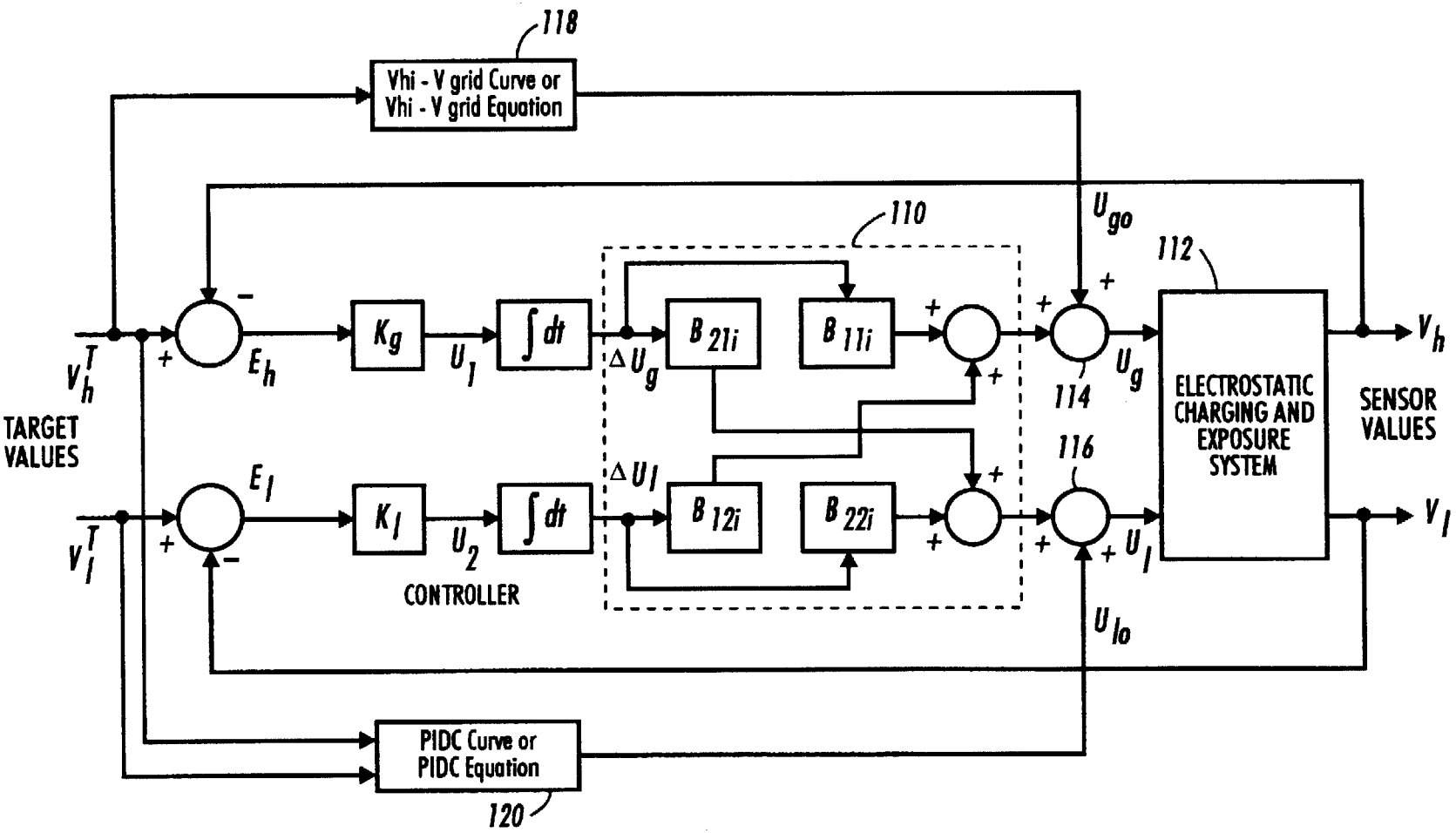
FIG. 3 illustrates a technique to implement the elements of a linearization look up table in an electrostatic control system in accordance with the present invention.

In FIG. 3, a technique to implement the elements of estimated look up table 110 including elements $B_{21i}$, $B_{12i}$, $B_{11i}$, and $B_{22i}$ is shown in diagrammatic form. The actuator signals $\Delta U_g$ and $\Delta U_l$ are passed through lookup table 110 and then added to the feedforward actuator signals $U_{go}$ and $U_{lo}$ at summing nodes 114 and 116 to generate $U_g$ and $U_l$, to control charging and exposure systems illustrated at 112. This type of formulation basically turns out to be one type of controller with gains obtained directly from the measurements on the electrosatic subsystem rather than by conventional trial and error methods of the past.

Look up tables 118 and 120 are formed from system charging and photo induced discharge curves or equations. Look up tables 118 and 120 place the system in a correct operating range, but look up table 110 provides precise, linear control for a given operating range. Operating alone, look up table 110 provides precise, linear control in a given operating range such as direct, linear control of the charging and exposive system 112. Operating in conjunction with feed forward look up tables 118 and 120, a control is provided by look up table 110 that puts the system at a correct operating point and also produces linearizes the system within that operating point.

The technique described above also applies to development systems for control. For development control, because of three different area coverage (or DMA) measurements, there are nine elements in the matrix. The small signal model for developability control is written as:

$$\begin{bmatrix} \Delta D1 = B11\Delta Vh + B12\Delta V1 + B13\Delta Vd \\ \Delta D2 = B21\Delta Vh + B22\Delta V1 + B23\Delta Vd \\ \Delta D3 = B31\Delta Vh + B32\Delta V1 + B33\Delta Vd \end{bmatrix}, \tag{8}$$

$$\text{i.e.,} \begin{bmatrix} \Delta D_1 \\ \Delta D_2 \\ \Delta D_3 \end{bmatrix} = \begin{bmatrix} B_{11} & B_{12} & B_{13} \\ B_{21} & B_{22} & B_{23} \\ B_{31} & B_{32} & B_{33} \end{bmatrix} \begin{bmatrix} \Delta V_h \\ \Delta V_1 \\ \Delta V_d \end{bmatrix}$$

Where $\Delta V_h$, $\Delta V_l$ and $\Delta V_d$ are the small control signals expected to change first level $V_h$ and $V_l$ target values and the donor voltage, $V_d$. They correspond to small signals $\Delta U_1$, $\Delta U_2$, and $\Delta U_3$, FIG. 4 describing implementation of the estimated lookup table for linearizing a non-linear system for development control. Also $\Delta D_1$, $\Delta D_2$, and $\Delta D_3$ are small deviations around the operating point $D_{1o}$, $D_{2_o}$ and $D_{3o}$ of the Area Coverage or DMA targets.

Figure 4:
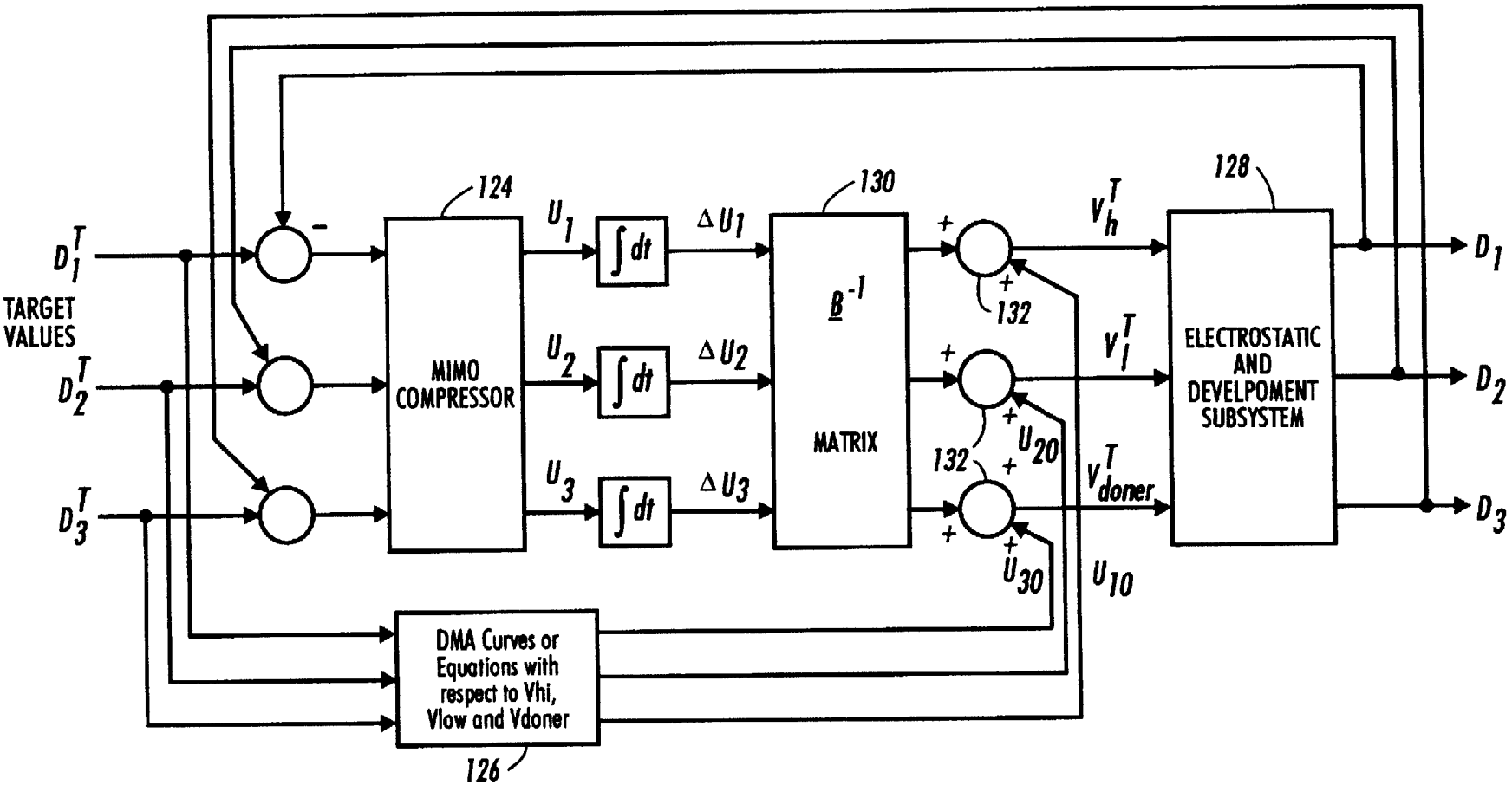
FIG. 4 illustrates a technique to implement the elements of a linearization look up table in a development control system in accordance with the present invention.

In FIG. 4 the linearization lookup table is shown by 130. The elements of the B matrix are extracted from the model curves to generate a linearizing look up table, called an estimated lookup table. The matrix is given by:

$$\underline{B}^{-1} = 1 \times 10^{-3} \begin{bmatrix} -0.44896 & -0.1427 & 0.3662 \\ -1.49388 & -0.7708 & 2.9785 \\ -1.0639 & -0.6897 & 2.368. \end{bmatrix}^{-1} = \begin{bmatrix} B_{11i} & B_{12i} & B_{13i} \\ B_{21i} & B_{22i} & B_{23i} \\ B_{31i} & B_{32i} & B_{33i} \end{bmatrix} \tag{9}$$

The elements of $B_{11i}$, $B_{12i}$, $B_{33i}$ are implemented in a similar way as that shown for the first level electrostatic control in FIG. 3. With reference to FIG. 4, signals derived from Multi Input/Output compensator 124 in response to signals from ETACs or OCD sensors measuring toner mass, and D1, D2, and D3 represent these different DMA measurements. These nominal actuator values are linearized by look up table 130 to control subsystem 128. An option is also to provide signals from feed forward look up table 126 to summing nodes 132 to place the control in a correct operating range as well as to provide linearization.

With the implementation of the linearization look up table, the system can be modeled with state space equation of the type shown in equation 7. With this approach, the controller gains are fixed. When the Area Coverage or DMA setpoints change, the operating points also change. For a new operating point, new sets of inverse $\underline{B}$ matrices are used. In this way the system as seen by the controller remains linear and is immune to changes in the operating points.

It is, therefore, apparent that there has been provided in accordance with the present invention, a charge control system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrostatographic printing machine having an imaging member with a surface voltage potential on a portion thereof, the electrostatographic printing machine including a control system having set point parameters with operating ranges comprising:

a sensor to measure the surface voltage potential, a device for changing the set point parameters, a first look up table responsive to the changing of the set point parameters to provide a first adjustment to the surface voltage potential, the first adjustment to the surface voltage potential placing the control in a modified operating range, and a second look up table responsive to the changing of the set point parameters to provide a second adjustment to the surface voltage potential, the second adjustment to the surface voltage potential placing the control in a relatively linear control mode within the modified operating range.

2. The electrostatographic printing machine of claim 1 including summing nodes responsive to the changing of the set point parameters to provide the linear control mode within the modified operating range.

3. The electrostatographic printing machine of claim 2, wherein the second look up table is an estimated look up table.

4. The electrostatographic printing machine of claim 3, including a summing node interconnected to a reference signal and the sensor measuring said surface voltage potential.

5. The electrostatographic printing machine of claim 1 including a second look up table responsive to the set point parameters.

6. An electrostatographic printing machine having an imaging member with a surface voltage potential on a portion thereof, the electrostatographic printing machine including a control system having set point parameters with operating ranges comprising:

a sensor to measure the surface voltage potential, a compensator responsive to a reference signal and the surface voltage potential, a look up table responsive to the changing of the set point parameters to provide operating range values, and an electrostatic device responsive to the compensator and the look up table to change the surface voltage potential in a linear manner.

7. The printing machine of claim 6, wherein the look up table includes means to provide different operating range values for changing set point parameters.

8. The printing machine of claim 7 wherein the means to provide different operating range values includes the means to provide linear values for changing set point parameters.

9. The electrostatographic printing machine of claim 6 including summing nodes responsive to the compensator and the look up table to change the surface voltage potential in a linear manner.

10. An electrostatographic printing machine having an imaging member with a surface voltage potential on a portion thereof, the electrostatographic printing machine including a control system having changeable set point parameters comprising:

a reference signal source, a sensor to measure the surface voltage potential, a compensator responsive to the reference signal and the surface voltage potential to provide a first adjustment signal, the first adjustment signal being non-linear, a look up table responsive to the first adjustment. signal to provide a linear adjustment signal, and an electrostatic device responsive to the linear adjustment signal to adjust surface voltage potential.

11. A printing machine having an imaging member with a surface voltage potential on a portion thereof, the printing machine including a control system having changeable set point parameters comprising:

a sensor to measure the surface voltage potential, a compensator responsive to the reference signal and the surface voltage potential to provide a first adjustment signal, the first adjustment signal being non-linear, a first look up table responsive to the first adjustment signal to provide a linear adjustment signal, a second look up table responsive to changing set point parameters, and an electrostatic device responsive to the linear adjustment signal and to the second look up table to adjust surface voltage potential.

12. The printing machine of claim 11 including a summing node responsive to the first and second look up tables to provides signals to the electrostatic device.

13. In an electrostatographic printing machine having an imaging member with a surface voltage potential on a portion thereof, the electrostatographic printing machine including a control system having a sensor and a compensator, a method of linearly adjusting the surface voltage potential comprising the steps of:

storing a reference signal, sensing the surface voltage potential, responding by the compensator to the reference signal and the surface voltage potential to provide an adjustment signal, a look up table responding to the adjustment signal to linearize the adjustment signal for adjusting the surface voltage potential.

14. In a printing machine having an imaging member with a surface voltage potential on a portion thereof, the printing machine including a control system having a sensor a method of linearly adjusting the surface voltage potential comprising the steps of:

storing a reference signal, sensing the surface voltage potential, responding to the reference signal and the surface voltage potential to provide an adjustment signal, and an estimated look up table responding to the adjustment signal to linearize the adjustment signal for adjusting the surface voltage potential.

15. The method of claim 14 including a compensator responsive to the reference signal and the surface voltage potential to provide an adjustment signal.

16. The method of claim 14 including summing node responsive to the means responding to adjust the surface voltage potential.

17. An electrostatographic printing machine having an imaging member and a plurality of operating components including a developer with toner for providing developed images, the electrostatographic printing machine including a control system having set point parameters comprising:

a sensor to measure developed toner mass on the imaging member a compensator responsive to said developed toner mass measured by the sensor to provide a first adjustment signal, a look up table responsive to the first adjustment signal to linearize the first adjustment signal, and circuitry responsive to the look up table to adjust the developed toner mass.

18. The electrostatographic printing machine of claim 17 wherein the circuitry responsive to the look up table includes a summing node.

19. The electrostatographic printing machine of claim 17 wherein the look up table is an estimated look up table.

20. An electrostatographic printing machine having an imaging member for providing developed images having a developed toner mass, the electrostatographic printing machine including a control system comprising:

a reference signal source, a sensor to measure the developed toner mass, a compensator responsive to the reference signal and the developed toner mass to provide an adjustment signal, a look up table responsive to the adjustment signal to provide a linear adjustment signal, and a device responsive to the linear adjustment signal to adjust the developed toner mass.

21. An electrostatographic printing machine having an imaging member and a plurality of operating components to provide images on support material, the electrostatographic printing machine including a control system having set points comprising:

a sensor to measure operating component parameters, a compensator responsive to said parameters measured by the sensor to provide a first adjustment signal for one of the operating components, a look up table responsive to the compensator to provide a linear first adjustment signal, and circuitry responsive to the linear first adjustment to adjust said one of the operating components.

22. The electrostatographic printing machine of claim 21 wherein said one of the operating components is a charging device.

23. The electrostatographic printing machine of claim 21 wherein said one of the operating components is a developer device.

24. In an electrostatographic printing machine having operating components and a control system including a sensor, a method of adjusting the operating components comprising the steps of:

sensing an operating component to provide a signal, responding to the signal to provide a non-linear adjustment signal, a look up table responding to the non-linear adjustment signal to provide a linear adjustment signal, and a device responding to the linear adjustment signal to adjust said operating component.

25. In an electrostatographic printing machine having operating components and a control system including a sensor, compensator, and look up table, a method of adjusting the operating components comprising the steps of:

sensing an operating component to provide a signal, responding to the signal by the compensator to provide a non-linear adjustment signal, responding to the non-linear adjustment signal by the look up table to provide a linear adjustment signal, and a device responding to the linear adjustment signal to adjust said operating component.

* * * * *